US007398875B2

(12) United States Patent
Niesar

(10) Patent No.: US 7,398,875 B2
(45) Date of Patent: Jul. 15, 2008

(54) TENSIONING PIECE OF A CONVEYOR CHAIN FOR A FILM WEB

(75) Inventor: Jürgen Niesar, Bad Laasphe (DE)

(73) Assignee: CFS Germany GmbH, Biedenkopf-Wallau (DE)

( * ) Notice: Subject to any disclaimer, the term of this patent is extended or adjusted under 35 U.S.C. 154(b) by 279 days.

(21) Appl. No.: 10/533,594

(22) PCT Filed: Oct. 31, 2003

(86) PCT No.: PCT/EP03/12118

§ 371 (c)(1),
(2), (4) Date: Sep. 19, 2005

(87) PCT Pub. No.: WO2004/041650

PCT Pub. Date: May 21, 2004

(65) Prior Publication Data

US 2006/0131137 A1 Jun. 22, 2006

(30) Foreign Application Priority Data

Nov. 5, 2002 (DE) ..... 102 51 740

(51) Int. Cl.
*B65G 47/84* (2006.01)

(52) U.S. Cl. ..... 198/803.7; 198/867.05; 226/173

(58) Field of Classification Search ..... 226/173; 198/803.7, 867.05, 803.8
See application file for complete search history.

(56) References Cited

U.S. PATENT DOCUMENTS

| | | | | | |
|---|---|---|---|---|---|
| 969,295 | A | * | 9/1910 | Meahl | 226/173 |
| 2,546,504 | A | * | 3/1951 | Head | 451/365 |
| 2,860,763 | A | * | 11/1958 | Kohrs | 198/404 |
| 3,726,389 | A | | 4/1973 | Klein et al. | 198/179 |
| 3,738,556 | A | | 6/1973 | Grebe | 226/173 |
| 3,837,474 | A | * | 9/1974 | Brooke | 198/377.06 |
| 4,397,411 | A | * | 8/1983 | Vetter et al. | 226/173 |
| 4,826,065 | A | * | 5/1989 | Natterer et al. | 226/173 |
| 4,846,064 | A | * | 7/1989 | Hoshi | 101/419 |
| 5,702,044 | A | * | 12/1997 | Christmann et al. | 226/173 |

FOREIGN PATENT DOCUMENTS

| | | | |
|---|---|---|---|
| DE | 572 755 | | 3/1933 |
| DE | 2 062 506 | | 6/1972 |
| DE | 23 55 921 | | 5/1975 |
| DE | 30 01 742 | A1 | 7/1981 |
| DE | 30 22 065 | C2 | 9/1983 |
| DE | 33 15 419 | A1 | 10/1984 |
| DE | 195 25 523 | A1 | 1/1997 |
| FR | 2.098.796 | | 3/1972 |
| FR | 2 484 381 | | 12/1981 |
| GB | 1 517 771 | | 1/1975 |
| GB | 1 487 129 | | 12/1975 |

* cited by examiner

*Primary Examiner*—Mark A Deuble
(74) *Attorney, Agent, or Firm*—Perman & Green, LLP

(57) ABSTRACT

The invention relates to a tensioning piece, a conveyor chain, and to a means for opening and closing the tensioning piece.

17 Claims, 8 Drawing Sheets

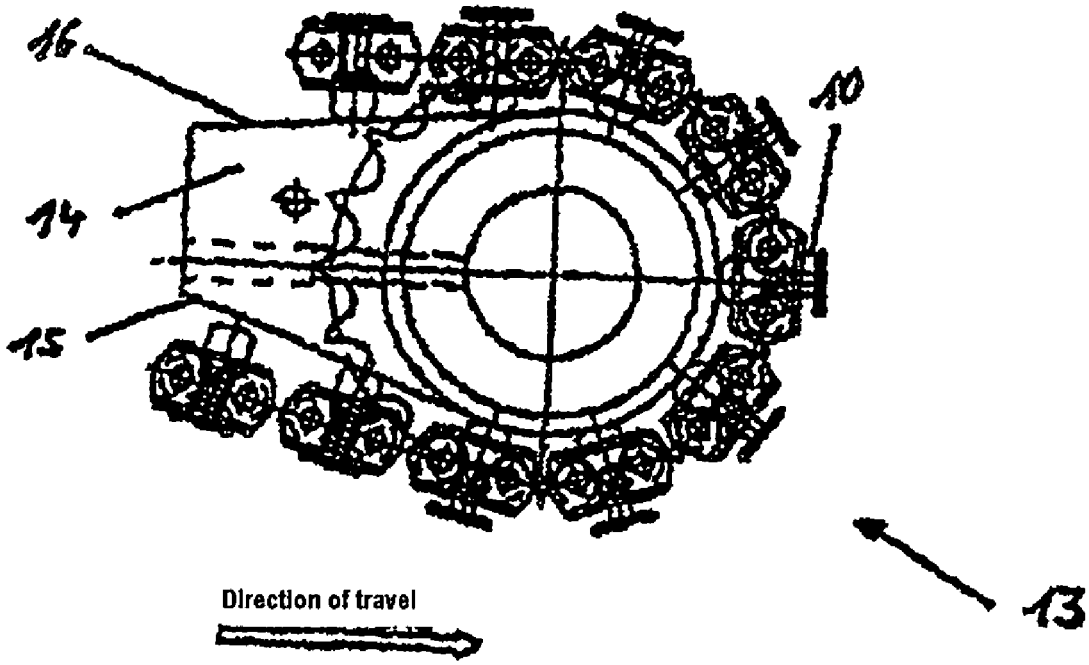
Fig.7
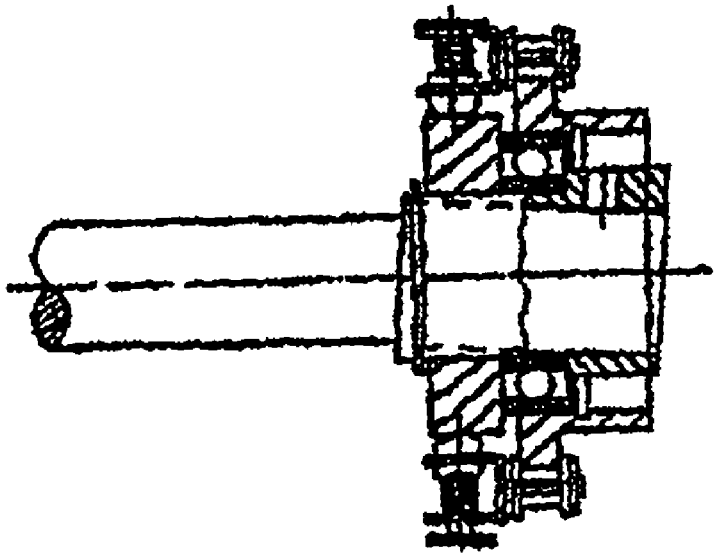

TENSIONING PIECE OF A CONVEYOR CHAIN FOR A FILM WEB

This application is the National Stage of International Application No. PCT/EP2003/012118, International Filing Date, Oct. 31, 2003, which designated the United States of America, and which international application was published under PCT Article 21(2) as WO Publication No. WO 2004/041650 A1 and which claims priority from German Application No. 102 51 740.1, filed Nov. 5, 2002.

BACKGROUND OF THE INVENTION

1. Field of the Invention

The present invention relates to a tensioning element, a chain conveyor and a means for opening and closing the tensioning element.

When conveying packaging film webs on packaging machines, it is necessary to pull the packaging film webs taut while simultaneously conveying them, wherein the packaging film web is clamped at the start of the machine and released again at the end of the packaging machine. The constantly alternating tensioning and releasing of the packaging film web requires a mechanism with which these procedures may be performed using simple means and with a high degree of reliability. According to the prior art, chains have proven effective for this purpose, each link being provided with a corresponding tensioning element, which is opened and closed again on passing over a first chain wheel, so clamping the packaging film web. On passing over a second chain wheel, the tensioning element is opened again and then closed, wherein in this case the packaging film web is released again.

2. Brief Description of Related Developments

The tensioning elements used therefor are disclosed in DE 195 25 523, DE 33 15 419, DE 23 55 921 and in FR 81 110 60. The tensioning elements according to the prior art have the disadvantage, however, of being comparatively complex to produce and/or of wearing comparatively quickly.

The object of the present invention was therefore to provide a tensioning element which does not exhibit the disadvantages of the prior art.

SUMMARY OF THE INVENTION

The object is achieved according to the invention with a tensioning element having:

a bearing bracket with a first and second surface, a clamping means, which is mounted displaceably in the bearing bracket and which comprises a clamping piece interacting with the first surface and a foot, wherein the clamping piece and the foot are connected together via a middle piece and the middle piece exhibits a smaller diameter than the foot and a spring, which interacts with the second surface and the foot.

Advantageous embodiments of the tensioning element according to the invention are claimed in the subclaims.

In a preferred embodiment of the present invention, the middle piece and the foot are mounted in the bearing bracket. This embodiment of the present invention has the advantage that the clamping piece is particularly well safeguarded against jamming on the bearing bracket.

The clamping means preferably consists of two parts, wherein in a particularly preferred embodiment of the present invention the clamping piece and the middle piece constitute one part and the foot is the other part. The clamping piece is likewise particularly preferably one part while the middle piece and the foot constitute the other part. The connection between the respective parts is preferably a material and/or frictional connection. In a preferred embodiment of the present invention, the bearing bracket is U-shaped.

Furthermore, on the first surface, which interacts with the clamping piece, the bearing bracket preferably comprises a preferably circular recess. Clamping of the packaging films is improved by this embodiment of the present invention.

It was extremely surprising and unexpected for the person skilled in the art that the tensioning element according to the invention is simple and cheap to produce. In addition, the tensioning element is distinguished by a low level of wear.

The tensioning element is preferably part of a chain conveyor for packaging film webs. The present invention therefore also provides a chain conveyor comprising the tensioning element according to the invention.

The present invention further provides a means for opening and closing a tensioning element of a chain conveyor, which means comprises two ramps, wherein the tensioning element is opened with the first ramp and closure of the tensioning element is controlled with the second ramp.

The two ramps preferably exhibit any desired angle relative to one another, which angle is adjustable in a particularly preferred embodiment of the present invention. However, the angle is preferably smaller than 180°, very particularly preferably smaller than 130° and most preferably smaller than 90°.

Furthermore the ramps preferably exhibit different gradients, wherein the gradient of the ramp which opens the tensioning element is preferably greater than the ramp with which the tensioning element interacts during its closure process. The person skilled in the art will recognise that it is also not essential for the ramp to be linear, it also being possible, for example, for it to be curved.

Preferably, the means according to the invention is arranged on the same axis as a gear wheel with which a chain is conveyed which comprises the tensioning elements to be opened and closed.

The means according to the invention has the advantage that it is simple and cheap to produce and exhibits low wear. The stress on the tensioning elements is substantially less in the case of the means according to the invention than in the case of the prior art.

The present invention further provides a disk for opening and closing a tensioning element, the axis of rotation of which is offset relative to the axis of rotation of a gear wheel with which a chain is conveyed which comprises the tensioning elements.

The disk is preferably circular. It is furthermore preferable for the disk to be mounted rotatably.

In a further preferred embodiment, the disk is mounted on the same shaft as the gear wheel of the chain. The axis of rotation of the disk and/or the axis of rotation of the gear wheel is preferably inclined relative to the vertical.

BRIEF DESCRIPTION OF THE INVENTION

The invention is explained below with reference to FIGS. 1-8. These explanations are given merely by way of example and do not restrict the general concept of the invention.

FIG. 7 shows another embodiment of the means for opening and closing the tensioning element.

DETAILED DESCRIPTION OF THE PREFERRED EMBODIMENT(s)

Figure 1:
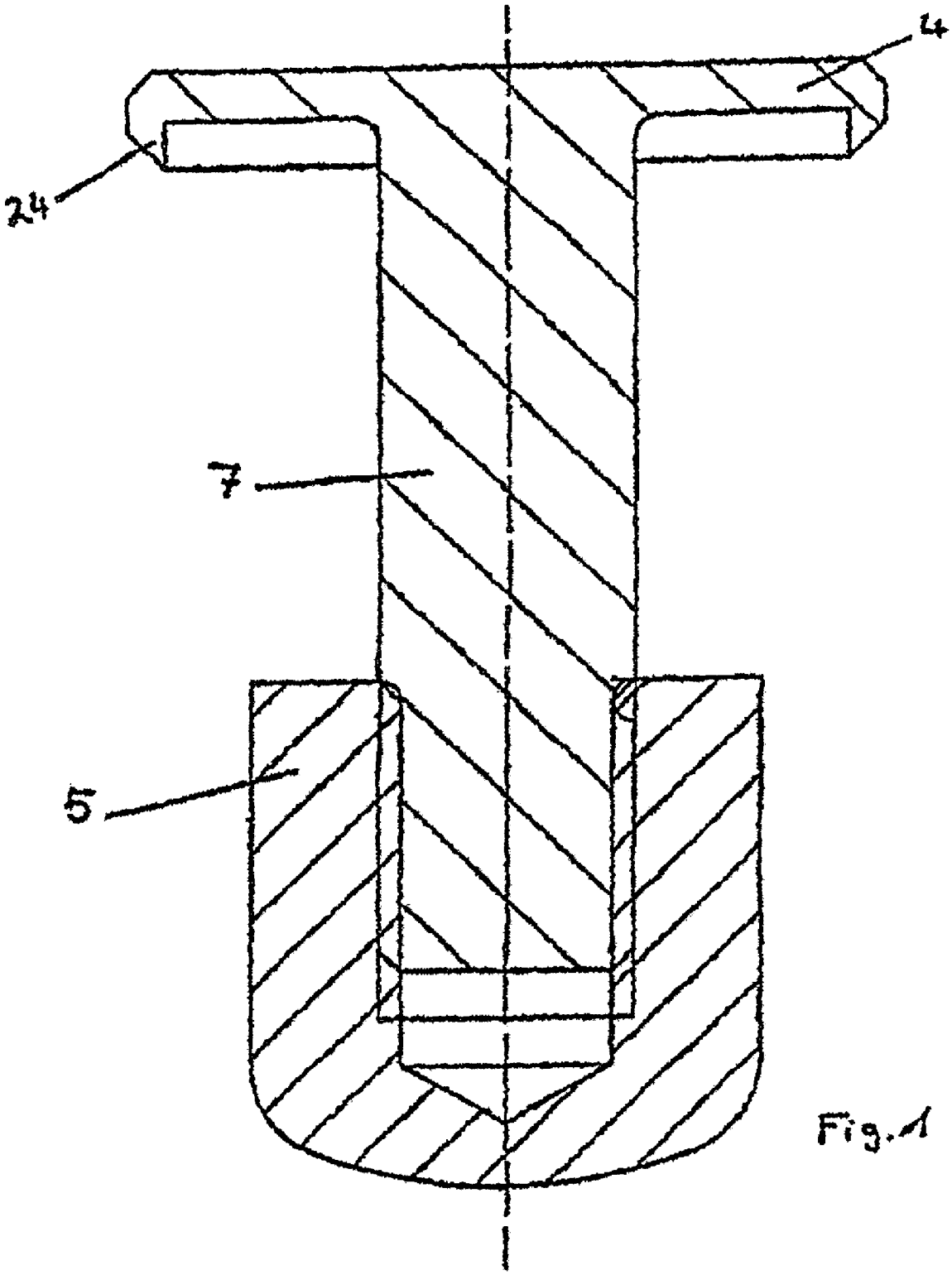
FIG. 1 shows an embodiment of the clamping means.

FIG. 1 shows an embodiment of the clamping means 3 of the tensioning element according to the invention. The clamping means 3 is in two parts, wherein in the present case the clamping piece 4 and the middle piece 7 constitute one part and the foot 5 constitutes the other part. The middle piece 7 and the foot 5 are screwed together. The screw connection may be secured for example by an adhesive. The clamping piece 7 comprises an annular bulge 24, with which the film is pressed against a bearing bracket (not shown).

Figure 2:
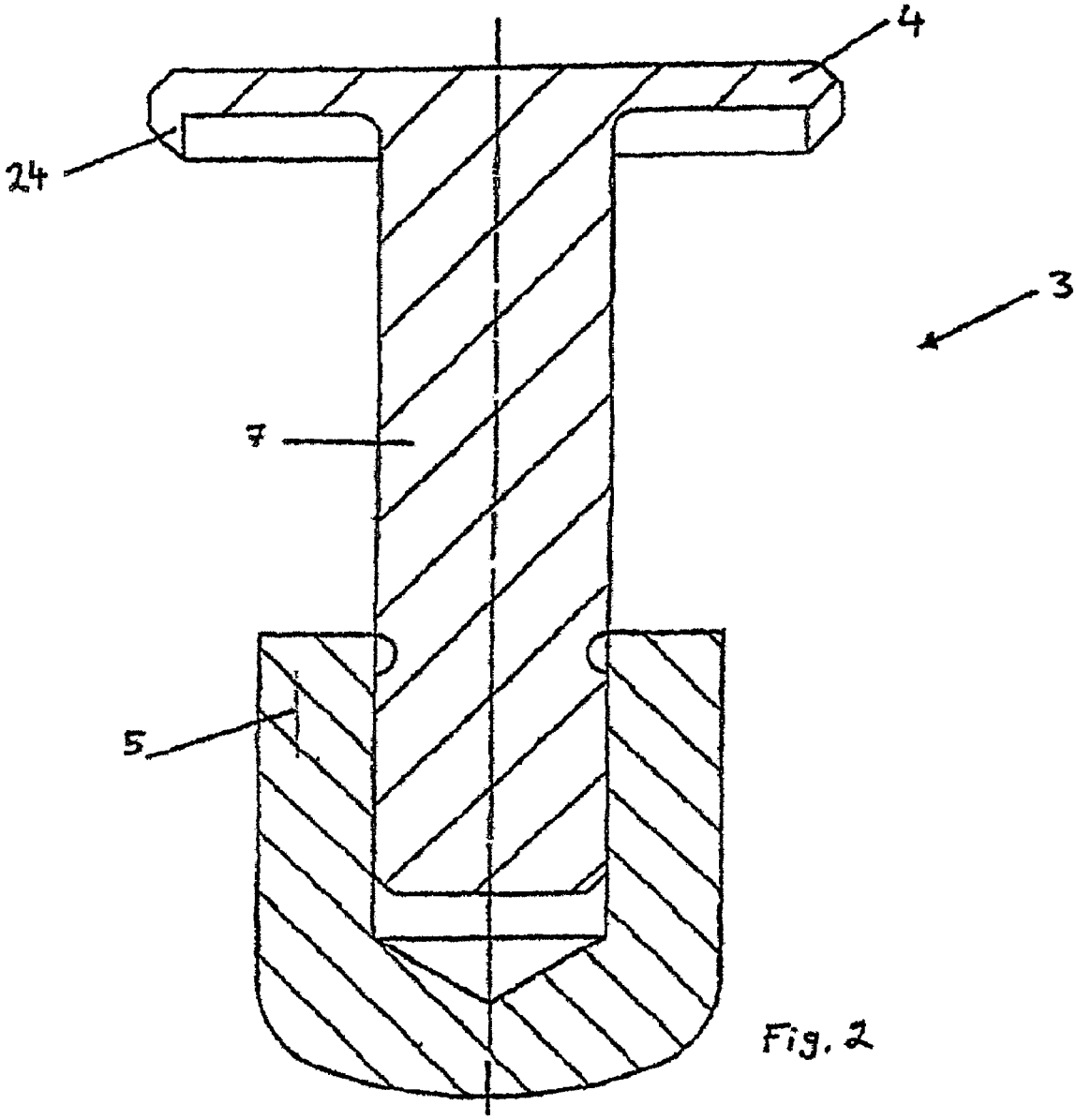
FIG. 2 shows another embodiment of the clamping means.

FIG. 2 shows another embodiment of the clamping means. This clamping means 3 corresponds substantially to the clamping means according to FIG. 1, with the exception that in the present case the middle piece 7 and the foot 5 are press-fitted together.

Figure 3:
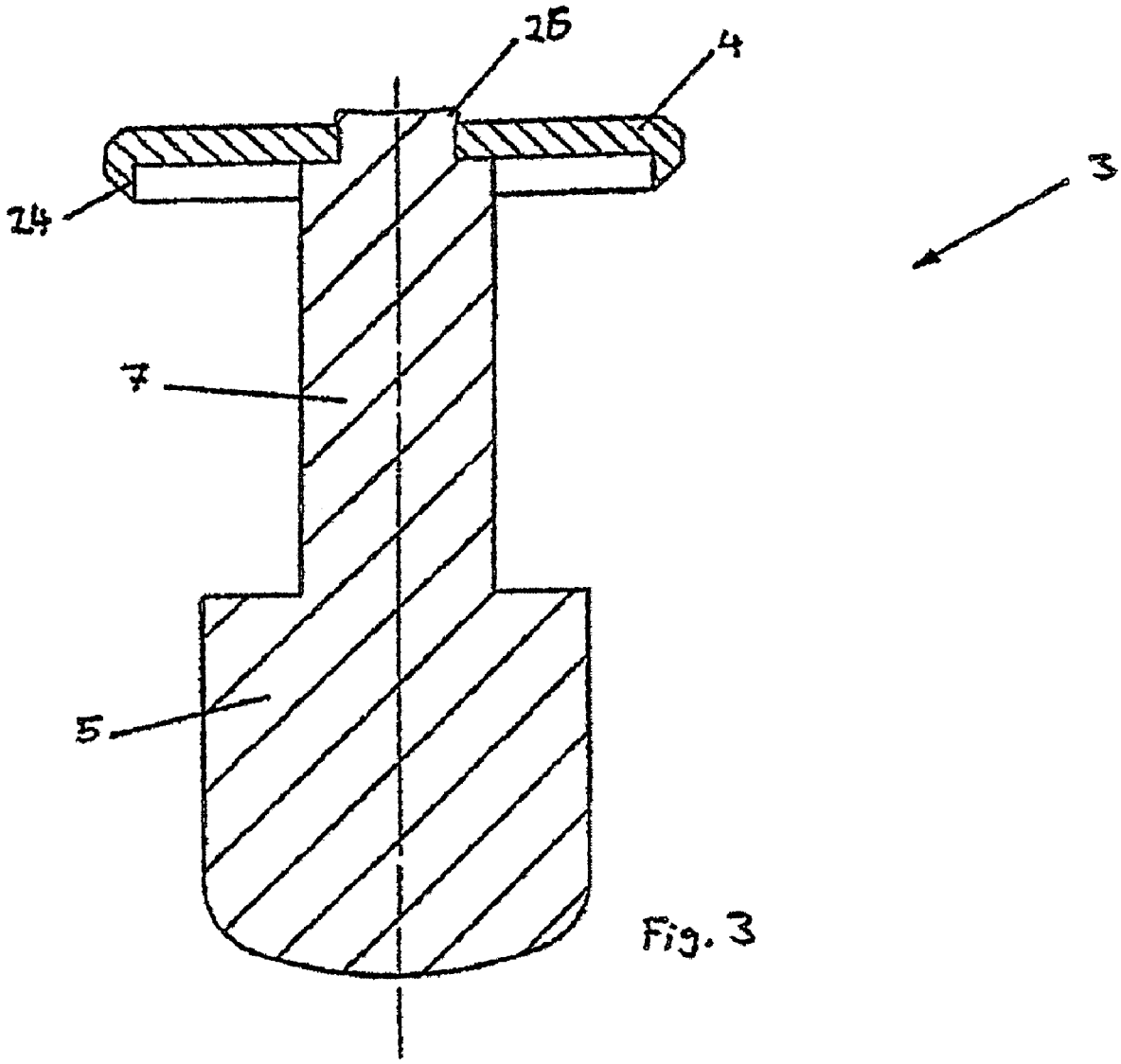
FIG. 3 shows a further embodiment of the clamping means.

FIG. 3 shows a further embodiment of the clamping means 3. The clamping means 3 is in two parts, wherein in the present case the foot 5 and the middle piece 7 constitute one part and the clamping piece 4 constitutes the other part. The middle piece 7 is connected with the clamping piece 4 by a flange 26. Otherwise the statements relating to FIG. 1 apply.

Figure 4:
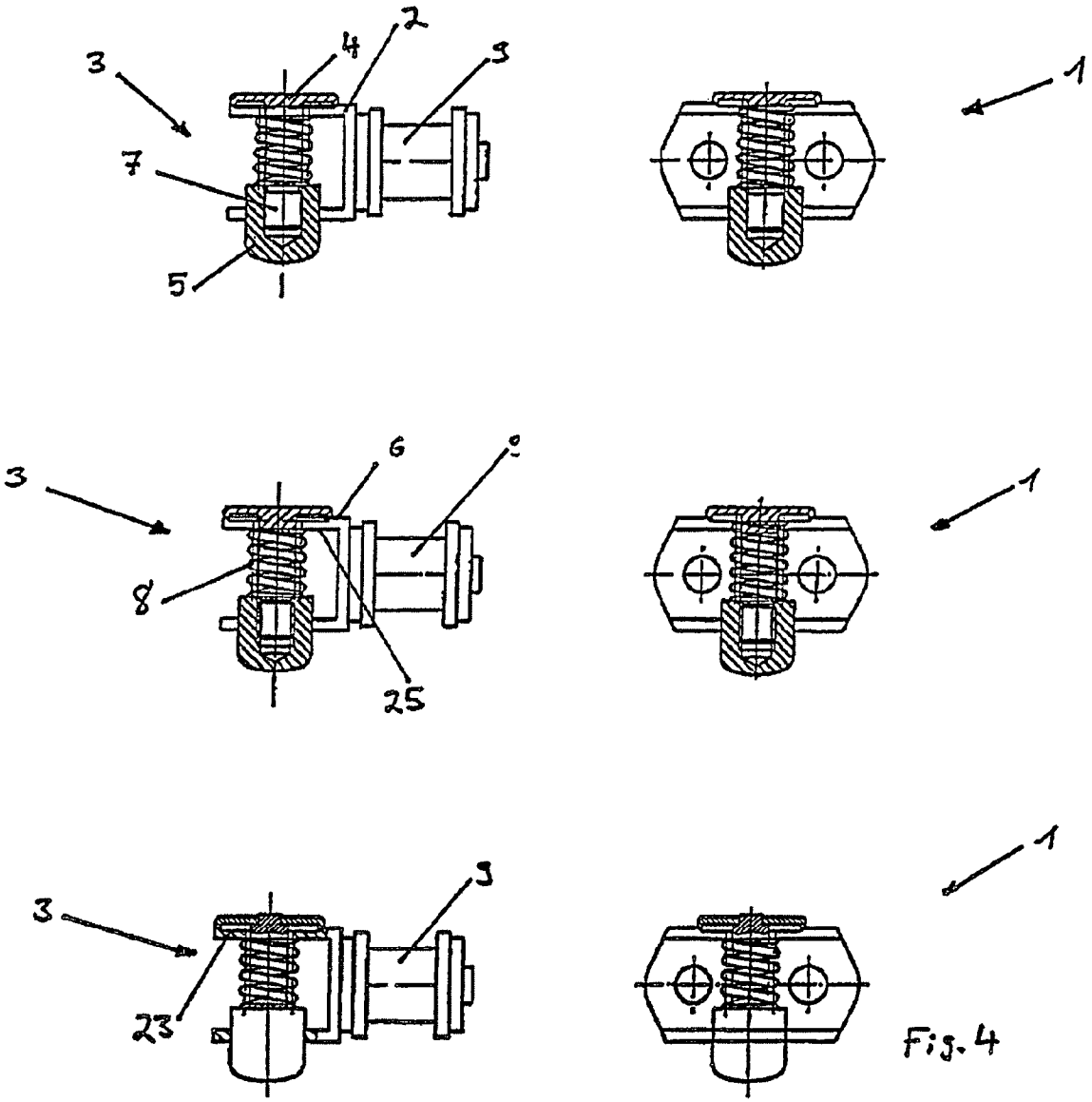
FIG. 4 shows three embodiments of the closed tensioning element according to the invention, in each case in two views.

FIG. 4 shows three embodiments of the closed tensioning element 1 according to the invention, in each case in two views. The tensioning elements 1 consist in each case of a U-shaped bearing bracket 2, in which the clamping means 3 is mounted so as to be displaceable substantially along its centre axis. The clamping means 3 correspond to the clamping means according to FIGS. 1-3. Each clamping means 3 comprises a clamping piece 4, a middle piece 7 and a foot 5, which are connected together. The clamping piece 4 interacts with the first surface 6 of the bearing bracket 2 in such a way that a film may be clamped therebetween. In the present case, the clamping piece comprises a bulge 24 and the surface 6 an indentation 23, such that the film is clamped along a segment of a circular ring. The middle piece 7 is mounted displaceably in a bore in the bearing bracket 2. The foot 5 is mounted displaceably in a further bore in the bearing bracket 2. A spring 8 is arranged in the area of the middle piece 7 and interacts at the one end with the foot 5 and at the other end with the surface 25 of the bearing bracket 2, such that the clamping piece 4 is drawn towards the surface 6 of the bearing bracket 2. The tensioning element 1 according to the invention is attached in each case to the links 9 of a chain conveyor. The chain conveyor is used, for example, to convey film webs in a packaging machine.

Figure 5:
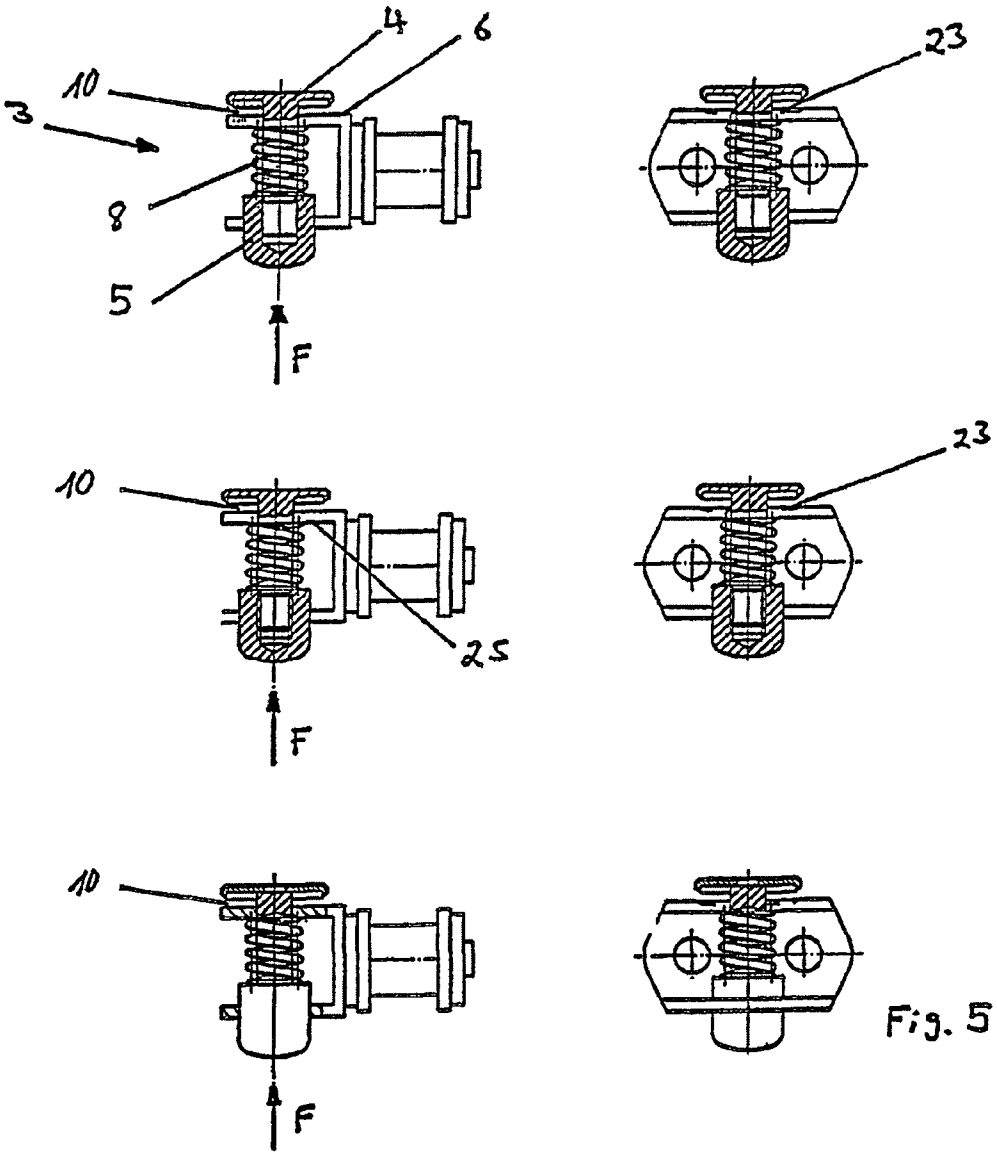
FIG. 5 shows three embodiments of the open tensioning element according to the invention, in each case in two views.

FIG. 5 shows the three embodiments illustrated in FIG. 4 of the tensioning element according to the invention in the open state. Opening is effected by a pressure force F, which acts from below on the foot 5 of the clamping means 3 and forces the clamping means 3 upwards relative to the bearing bracket 2, such that a gap 10 arises between the clamping piece 4 and the first surface 6, into which gap the edge of the film (not shown) may be introduced. The person skilled in the art will recognise that the force F does not have to act directly from below. By the upward displacement of the clamping means 3 the spring 8 is compressed between the second surface 25 and the foot 5. Once the edge of the film has been introduced into the gap 10, the force F is reduced in such a way that the restoring force of the spring recloses the gap 10, clamping the edge of the film between the clamping piece 4 and the surface 6. In the open state, the recess 24 in the surface 6 is visible, which recess interacts with the bulge 23 such that the edge of the film is clamped along a segment of a circular ring. The person skilled in the art will recognise that opening and closing of the tensioning element according to the invention may be performed as often as desired.

Figure 6:
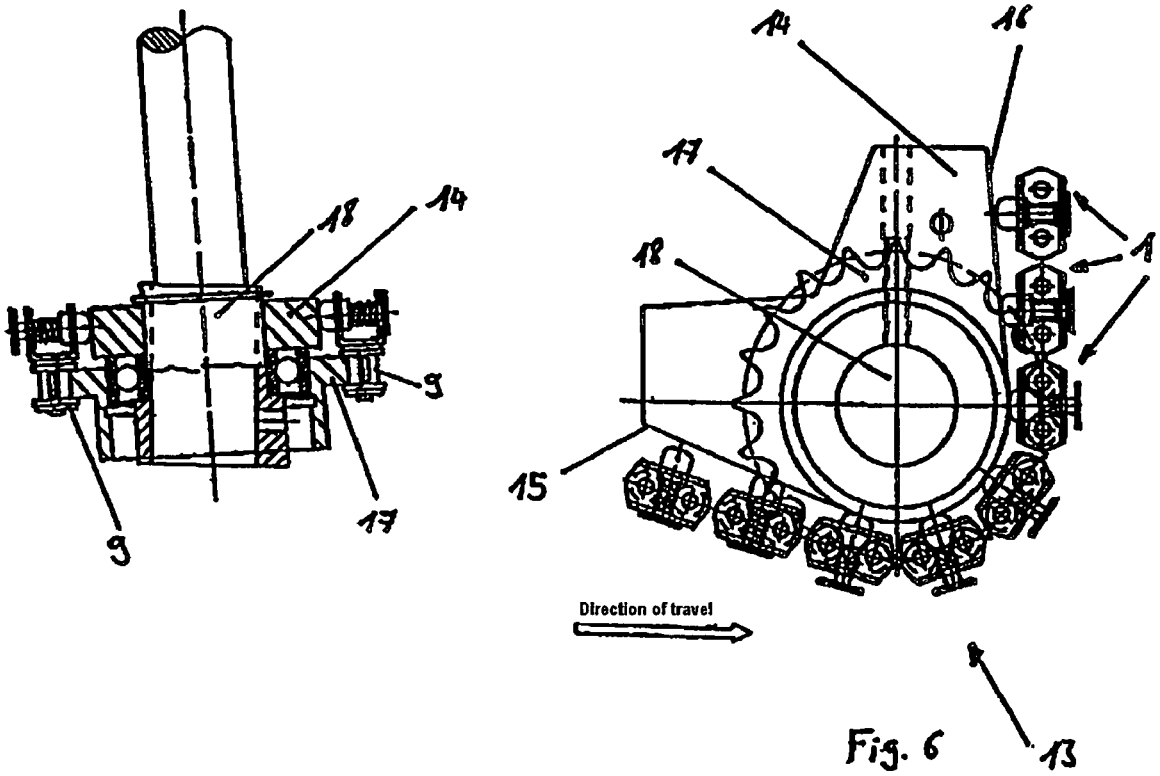
FIG. 6 shows an embodiment of the means for opening and closing the tensioning element.

FIG. 6 shows an embodiment of a means 14 according to the invention for opening and closing the tensioning element 3, which is attached in each case to a link 9 of the chain conveyor 13 (illustrated only in part). The chain conveyor 13 is driven and/or deflected by the gear wheel 17. The direction of travel of the chain conveyor 13 is indicated by the arrow. The means 14 is arranged on the same shaft 18 as the gear wheel 17, but stationarily. The means 14 comprises two ramps 15, 16. The feet 5 of the tensioning elements 1 run firstly over the ramp 15 and are pressed upwards in the process, such that the tensioning element 1 is opened gradually. After opening and once the edge of the film (not shown) has been inserted, the foot 5 runs along the ramp 16 and the tensioning element 1 closes again slowly until it is completely closed and the film web is clamped. The person skilled in the art will recognise that the ramps may each exhibit any desired form which is optimally conformed to the desired opening and closing behaviour of the tensioning element. The more quickly opening or closure of the tensioning element is intended to take place, the steeper the ramp must be and vice versa. However, it is also entirely feasible for the ramps to take the form of a curve and/or for the ramps 15, 16 each to differ in length and/or gradient. The ramps have the advantage in particular of preventing abrupt opening or closure of the tensioning element, as is conventional with means of opening and closing the tensioning element according to the prior art, so reducing wear and distortion and/or tearing of the clamped film.

FIG. 7 shows another embodiment of a means according to the invention for opening and closing the tensioning element, which differs from the means according to FIG. 6 in that the angle between the two ramps 15, 16 is smaller in the present example than in the example according to FIG. 6.

Figure 8:
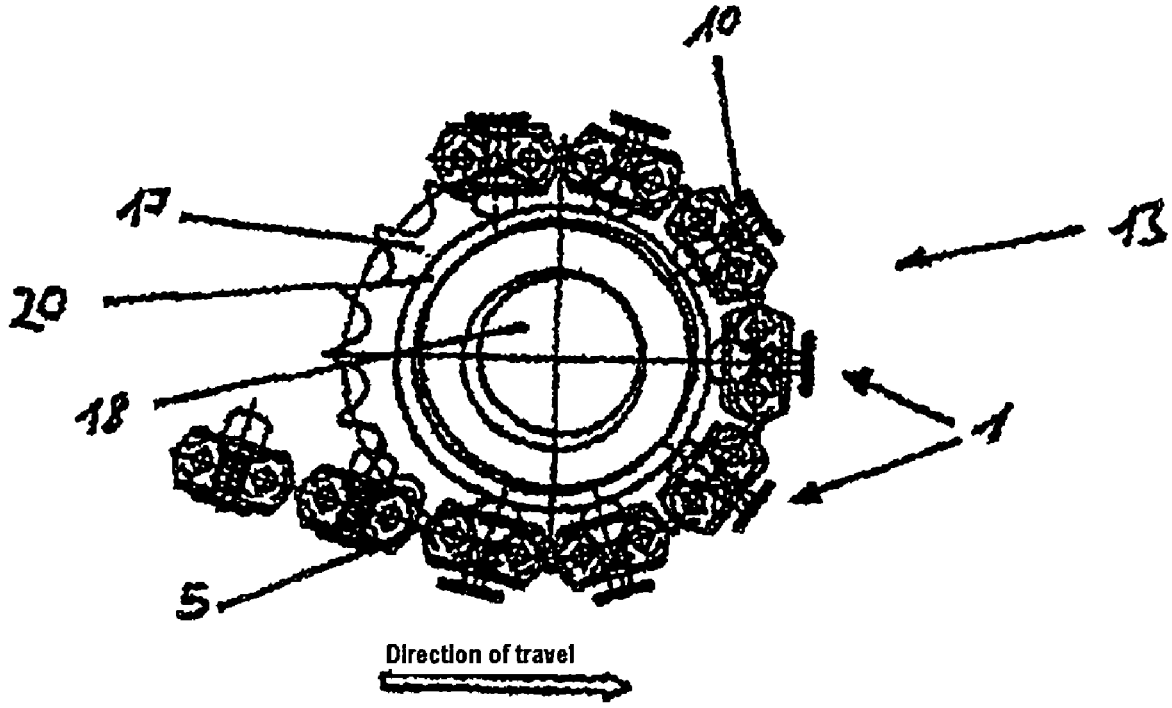
FIG. 8 shows a further embodiment of the means for opening and closing the tensioning element.
Figure 8:
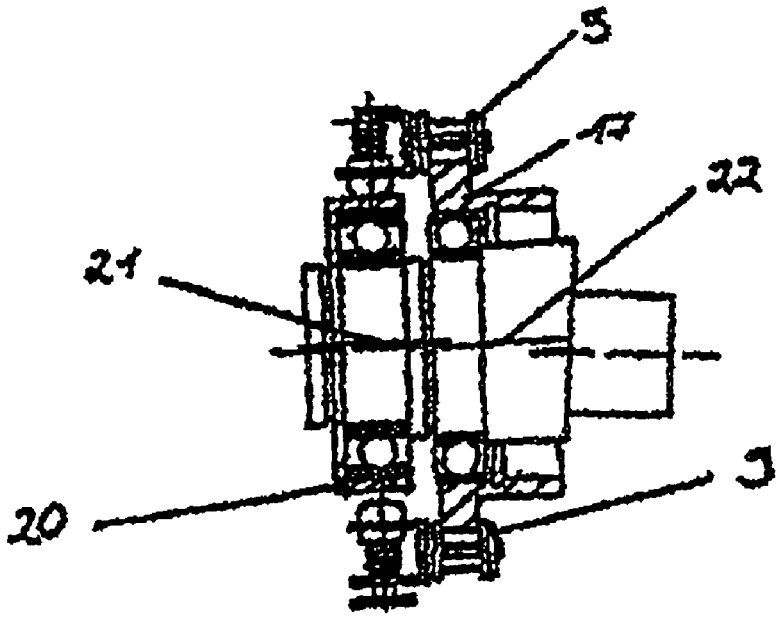

FIG. 8 shows a further embodiment of a means for opening and closing the tensioning element, which is attached in each case to a link 9 of the chain conveyor 13 (illustrated only in part). The chain conveyor 13 is driven and/or deflected by the gear wheel 17. The direction of travel of the chain conveyor 13 is indicated by the arrow. In the present case, the means is a rotatably mounted disk 20, whose axis of rotation 21 is offset relative to the axis of rotation 22 of the gear wheel 17. As soon as the foot 5 comes into contact with the disk 20, the clamping means 3 is displaced in the bearing bracket 2 in such a way that a gap 10 forms between the clamping piece 4 and the surface of the bearing bracket, into which gap the edge of the film may be introduced. The tensioning element is closed in like manner.

The invention claimed is:

1. A tensioning element (1) having:

a U-shaped bearing bracket (2) with a first and second surface (6, 25) and two oppositely located bores, a first bore having a smaller diameter than an oppositely located second bore, a clamping means (3), which is mounted displaceably in the bearing bracket (2) and which comprises a clamping piece (4) interacting with the first surface (6) and a foot (5), wherein the clamping piece (4) and the foot (5) are connected together by a middle piece (7), a spring (8) having a first end which interacts with the second surface (25) and a second opposite end which interacts with the foot, whereas the middle piece (7) has a smaller diameter than the foot (5), the middle piece (7) is mounted displaceably in the first bore and the foot (5) is mounted displaceably in the second bore.

2. A tensioning element according to claim 1, characterised in that the middle piece (7) and the foot (5) are mounted displaceably in the bearing bracket.

3. A tensioning element according to claim 2, characterised in that the clamping means (3) consists of two parts.

4. A tensioning element according to claim 3, characterised in that the clamping piece (4) and the middle piece (7) constitute the one part and the foot (5) is the other part.

5. A tensioning element according to claim 3, characterised in that the clamping piece (4) is the one part and the middle piece (7) and the foot (5) constitute the other part.

6. A tensioning element according to claim 3, characterised in that the connection between the parts is a material and/or frictional connection.

7. A tensioning element according to claim 1, characterised in that the bearing bracket (2) comprises an annular recess (23) in the first surface (6).

8. A tensioning element according to claim 7, characterised in that the clamping piece (4) comprises an annular bulge (24), which interacts with the recess (23).

9. A tensioning element according to claim 1, characterised in that it is part of a chain (13), where the chain comprises a chain conveyor for film webs.

10. A chain conveyor for film webs, characterised in that it comprises tensioning elements according to claim 1.

11. A means according to claim 10, characterised in that the ramps (15, 16) are arranged at an angle to one another of less than 180°.

12. A means (14) for opening and closing the tensioning element (1) according to claim 1, characterised in that it comprises two ramps (15, 16), wherein the tensioning element (1) is opened with the ramp (15) and closure of the tensioning element (1) is controlled with the ramp (16).

13. A means according to claim 12, characterised in that the gradient of each of the ramps (15, 16) is different.

14. A means (19) for opening and closing the tensioning element (1) according to claim 1, characterised in that it is a circular disk (20), the axis of rotation (21) of which is offset relative to the axis of rotation (22) of a gear wheel (17), with which a chain (13) is conveyed which comprises the tensioning elements (1).

15. A means according to claim 14, characterised in that it is mounted rotatably.

16. A means according to claim 14, characterised in that it is mounted on a shaft (18) with the gear wheel (17) of the chain (13).

17. A means according to claim 14, characterised in that the axis of rotation (21) and/or the axis of rotation (22) are inclined relative to the vertical.

* * * * *